US007806187B2

(12) United States Patent
Lugo

(10) Patent No.: US 7,806,187 B2
(45) Date of Patent: Oct. 5, 2010

(54) CONNECTOR ASSEMBLY FOR CONNECTING A HOT STAB TO A HYDRAULIC HOSE

(75) Inventor: Mario R. Lugo, Spring, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 34 days.

(21) Appl. No.: 12/123,437

(22) Filed: May 19, 2008

(65) Prior Publication Data

US 2009/0283274 A1 Nov. 19, 2009

(51) Int. Cl.
*E21B 43/01* (2006.01)

(52) U.S. Cl. ..... 166/339; 166/338; 166/344; 166/347; 285/114; 285/115; 285/116

(58) Field of Classification Search ..... 166/339, 166/338, 344, 347, 351, 367; 405/191, 169; 138/155, 109; 285/114–116
See application file for complete search history.

(56) References Cited

U.S. PATENT DOCUMENTS

| | | | | |
|---|---|---|---|---|
| 3,454,291 | A * | 7/1969 | Jonah et al. | 285/371 |
| 4,438,954 | A * | 3/1984 | Hattori | 285/104 |
| 4,666,191 | A * | 5/1987 | Sotelo et al. | 285/222.2 |
| 4,682,913 | A * | 7/1987 | Shatto et al. | 405/169 |
| 4,695,190 | A | 9/1987 | Best et al. | |
| 4,819,974 | A * | 4/1989 | Zeidler | 285/373 |
| 4,863,314 | A * | 9/1989 | Baugh | 405/191 |
| 4,878,783 | A * | 11/1989 | Baugh | 405/169 |
| 5,143,483 | A | 9/1992 | Peterson | |
| 5,361,806 | A * | 11/1994 | Lalikos et al. | 138/109 |
| 5,570,909 | A * | 11/1996 | Reynolds, Jr. | 285/90 |
| 5,797,633 | A * | 8/1998 | Katzer et al. | 285/243 |
| 5,988,281 | A | 11/1999 | Douglas et al. | |
| 6,009,950 | A * | 1/2000 | Cunningham et al. | 166/344 |
| 6,200,068 | B1 | 3/2001 | Bath et al. | |
| 6,604,762 | B2 * | 8/2003 | Sagaser | 285/353 |
| 7,096,937 | B2 * | 8/2006 | Bartlett et al. | 166/86.2 |
| 7,204,524 | B2 * | 4/2007 | Eccleston | 285/258 |
| 7,325,598 | B2 | 2/2008 | Bartlett | |
| 7,404,582 | B2 * | 7/2008 | Scartozzi et al. | 285/404 |
| 2005/0093293 | A1 * | 5/2005 | Schwarz et al. | 285/247 |

* cited by examiner

*Primary Examiner*—Thomas A Beach
*Assistant Examiner*—Matthew R Buck
(74) *Attorney, Agent, or Firm*—Egbert Law Offices PLLC

(57) ABSTRACT

An apparatus having a hot stab having a fluid conduit connector thereon, a hydraulic hose having a connector assembly at an end thereof suitable for joining to the fluid conduit connector of the hot stab, and a sleeve affixed to the hot stab and to the hydraulic hose so as to extend over and surround the fluid conduit connector and the connector assembly. A jam nut is affixed to the tubular portion of the fluid conduit connector. The sleeve is threadedly connected to the threaded exterior surface of the jam nut. A crimp fitting is secured to an end of the hydraulic hose. A hose swivel extends around a crimp fitting and is affixed around the fluid conduit connector of the hot stab.

12 Claims, 2 Drawing Sheets

CONNECTOR ASSEMBLY FOR CONNECTING A HOT STAB TO A HYDRAULIC HOSE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to hot stabs that are used by ROVs. More particularly, the present invention the relates to leakage-preventing devices as used with hydraulic hoses.

2. Description of Related Art Including Information Disclosed Under 37 CFR 1.97 and 37 CFR 1.98

As offshore drilling and completion operations progress into deeper waters, especially into waters of greater than 1000 feet, many relatively simple surface operations become complex and costly. One frequent operational requirement is that of engaging a hydraulic stab sub receptacle with a probe for the purpose of applying hydraulic flow and pressure to operate a particular function. The function can be a valve, a blowout preventor, a test port, or other items.

These connections can be made by divers, by ROV's (Remotely Operated Vehicles) which are free swimming, or by manipulators that are guided into place. The probe that is used by these ROV's is commonly known as a "hot stab".

One of the main problems with the existing hot stabs is that the hydraulic hose must be connected to the hot stab. During frequent manipulation of the hot stab by the ROV, the hydraulic hose can become twisted, contorted, or otherwise angularly displaced with respect to the hot stab probe. Presently, hydraulic hoses are connected to the hot stab probe by a fitting similar to that of a garden hose. In other words, there is a hose swivel that is joined to a threaded portion on the fluid conduit connector of the hot stab. The rotation of the hose swivel causes a crimp fitting at the end of the hydraulic hose to become engaged in surface-to-surface contact with an angled surface formed at the end of the fluid conduit connector of the hot stab.

Unfortunately, since a great deal of force can be applied to this relatively small connection, leaks are quite common in the area of the connection between the crimp fitting of the hydraulic hose and the fluid conduit connector of the hot stab. This particularly a problem when the hot stab is required to carry fluids delivered by relatively wide diameter and heavy hydraulic hoses. As manipulations continue, the likelihood of a leak becomes more pronounced. When these leaks occur, it is necessary for the ROV to travel to the surface for repair and maintenance. In each circumstance that the ROV is required to return to the surface, a great deal of time, expense and labor is wasted. As such, a very strong need has developed whereby the possibility of leakage from the connection between the hydraulic hose and the hot stab is effectively prevented.

In the past, various patents have issued relating to such hot stab connectors. For example, U.S. Pat. No. 4,682,913, issued on Jul. 28, 1987 to Shatto et al., describes a hydraulic stab connector. In particular, this patent discloses an apparatus and method for connecting a fluid conduit carried by an ROV to a fluid conduit of a subsea equipment assembly, such as a hydraulically-actuated device, in a non-binding manner. The apparatus includes a vacuum-locking device, such as a hydraulically-actuatable suction lock assembly, which is selectively actuatable to lock or unlock the apparatus with respect to the device of the assembly.

U.S. Pat. No. 4,695,190, issued on Sep. 22, 1987 to Best et al., teaches a pressure-balanced stab connection. This apparatus includes a stab member with a body having a bore therethrough. One end of the bore exits from the stab body through a side port. A stab receptacle includes a bore for receiving the stab body, and a flow bore intersecting the receiving bore and leading to the exterior of the receptacle. The side port communicates with the receptacle flow bore when the stab member is landed in the receiving bore. Seals above and below the side port seal the receiving bore above and below the intersection of the receptacle flow bore and receiving bore. The cross-sectional areas of the seals exposed to internal fluid pressure are substantially equal, resulting in zero blow-apart force on the stab connection.

U.S. Pat. No. 4,863,314, issued on Sep. 5, 1989 to B. F. Baugh, shows a hydraulic stab sub with multiple seals for use in remote and harsh environments. This hydraulic stab sub has the ability to move the seals radially inwardly to a retracted position in which the hydraulic stab sub can be easily inserted into a mating receptacle and alternately to move the seals radially outward to perform useful functions such as sealing or locking into the receptacle.

U.S. Pat. No. 4,878,783, issued on Nov. 7, 1989 to B. F. Baugh, shows a hydraulic stab sub connector with the angular freedom. This hydraulic stab sub is designed for use in remote and harsh environments. The stab sub is capable of being inserted into a close fitting receptacle at a relatively high angular mismatch by providing for radial relative movement of sealing rings and seal holding rings with reference to the centerline of the hydraulic stab sub.

U.S. Pat. No. 5,143,483, issued on Sep. 1, 1992 to W. H. Peterson, shows a hydraulic stab sub for use in a remote location that can be inserted into a receptacle with the seals in a retracted position. The seals are expanded to a sealing portion using hydraulic pressure while an hydraulic piston is provided for removing the stab sub from the receptacle.

U.S. Pat. No. 5,988,281, issued on Nov. 23, 1999 to Douglas et al., teaches an engageable metal seal pressure balance stab. In particular, the invention provides for the connection of a pressure-balanced stab and a manifold in which offsetting forces maintained on the stab allow it to remain in an inserted state within the manifold without the use of a significant amount of force to maintain the connection. The offsetting forces are contained within the stab through the use of C-ring seals on the stab. These seals are activated by a downward force created by an actuator. The compression of the C-rings is delayed until insertion is complete, therefore allowing an installation which does not damage the seals.

U.S. Pat. No. 6,009,950, issued on Jan. 4, 2000 to Cunningham et al., provides a subsea manifold stab with an integral check valve. This is for gas-lift injection processes and includes a built-in check valve to exclude seawater as the stab is being delivered to the subsea manifold. The check valve is a spring-loaded poppet which can be pressure-balanced with the surrounding hydrostatic forces, or alternatively, preloaded with the use of a pressurized chamber working in conjunction with a biasing spring to hold the check valve in the closed position during delivery. After insertion of the stab into the subsea manifold, the gas flow begins in the stab, which overcomes the forces of the spring and/or pressurized compartment to push the check valve into the open position to allow gas-lift flow through the manifold and down the annulus into the gas-lift valves in the well.

U.S. Pat. No. 6,200,068, issued on Mar. 13, 2001 to Bath et al., provides a hot tap fluid blaster apparatus. This apparatus serves to remove a blockage in a subsea pipeline without retrieval of the pipeline to the surface. The apparatus components include a hot tap saddle, a drill assembly, a fluid blaster assembly and a support frame. The hot tap saddle component has a first portion and a second portion, with these portions being configured to clampingly engage in a sealing relationship to the subsea pipeline. The first portion of the saddle includes a first and second opening with the first opening extending generally upwardly and configured for connecting to a drill assembly and the second opening being positioned generally at an angle to the first opening and configured for connecting to a fluid blaster assembly.

U.S. Pat. No. 7,325,598, issued on Feb. 5, 2008 to C. D. Bartlett, discloses a vacuum-assisted seal engagement for ROV-deployed equipment. The apparatus includes a bore that is sized and configured to receive a depending portion. The first and second components are exposed to a fluid which is at an ambient pressure. The method includes the steps of inserting the depending portion at least partially into the bore and then creating a bore pressure within the bore which is less than the ambient pressure.

FIG. 1 shows an conventional system in which a hydraulic hose is connected to a hot stab of an ROV. FIG. 1 shows one type of prior art system that can employ the present invention. In FIG. 1, a vessel 10 is shown floating upon the surface 11 of the body of water 12. A riser assembly 13 extends downwardly from the vessel 10 from the bottom 14 of the body of water 12. The lower elements of the riser assembly 13 include a subsea wellhead assembly 20 typically positioned on the bottom of the body of water 12 and extending downwardly into the earth formation for drilling and completion operations. The subsea wellhead assembly 20 comprises various components such as hydraulically-actuated valves 24 and 25 which are actuated by valve actuators 42 and 26, respectively. The actuators are normally controlled through shuttle valves 16 and 15 using a surface pressure source 33 via line 43 to a control pod 44 in a manner well known in the art. The hot stab 27 serves to a supply auxiliary pressurized fluid to the subsea equipment assembly. The hot stab 27 is carried by the ROV 31. The hot stab 27 is carried by or gripped, preferably in a removable manner, at one end by a manipulator arm 30 carried by the ROV 31. The manipulator arm 30 serves to direct the hot stab 27 toward a receptacle 28. The ROV 31 can be manipulated so as to cause the hot stab 26 to move into proximity with another receptacle 23.

In FIG. 1, the hot stab 27 is shown near the hydraulic valve actuator 26 which has the receptacle 28 for receiving the hot stab 27. The hot stab 27 is in fluid communication with hydraulic hose 29. The hydraulic hose 29 can be in the form of a hydraulic cable, conduit or hose. The conduit 29 supplies pressurize hydraulic fluid from a fluid source 33 on the vessel 10 by way of a winch 32 to the hot stab 27 in a manner known in the art.

The ROV 31 can be powered by a power and signal and transition cable 34 which has been reeled off the service vessel 10, in particular, from the winch 35. The ROV 31 may be remotely operated from the vessel 10 by observation of video signals received from cameras carried by the ROV 31.

As stated earlier, one of the problems with the prior art is the connection between the hydraulic hose 29 and the hot stab 27. In normal use, this connection is a relatively simple hydraulic connection. However, in view of the relatively heavy weight of the hydraulic hose 27 and the degree of manipulation carried out by the ROV 31 and the manipulator arm 30, a great deal of bending, twisting and other forces can be applied to this connection. In a relatively short period of time, leaks can occur in this connection. As such, a strong need has developed so as to provide the connector assembly such that the leaks can be avoided. As such, the number of times that the ROV 31 must traverse the distance to the surface 11 can be significantly reduced.

It is an object of the present invention to provide a connector assembly for a hot stab which serves to avoid leaks.

It is another object of the present invention to provide a connector assembly which serves to transfer loads away from the seal surface between the connector assembly of the hydraulic hose and the fluid conduit connector of the hot stab.

It is still a further object of the present invention to provide a connector assembly which minimizes the number of times that the ROV must return to the surface for leakage repair.

It is still another object of the present invention to provide a connector assembly which serves to reduce the cost associated with operating the ROV and for carrying out the necessary operations for the offshore well.

These and other objects and advantages of the present invention will become apparent from a reading of the attached specification and appended claims.

BRIEF SUMMARY OF THE INVENTION

The present invention is a leak preventing apparatus for use in association with the hot stab of an ROV. The apparatus comprises a hot stab having a fluid conduit connector thereon, a hydraulic hose having a connector assembly at an end thereof that is joined to the fluid conduit connector of the hot stab, and a sleeve affixed to the hot stab and to the hydraulic hose so as to extend over and surround the fluid conduit connector and the connector assembly.

In the present invention, the sleeve has a first hole formed through a wall thereof adjacent one end and a second hole formed through the wall thereof adjacent an opposite end. A first set screw is affixed within the first hole and in compressive contact with a surface of the fluid conduit connector. A second set screw is affixed in the second hole and in compressive contact with a surface of the connector assembly of the hydraulic hose.

The fluid conduit connector has a tubular portion. A jam nut is affixed to the tubular portion. The sleeve extends over this jam nut. In particular, the jam nut has a threaded exterior surface. The sleeve is threadedly connected to the threaded exterior surface of the jam nut.

The fluid conduit connector has a tubular portion. This tubular portion has a notch formed circumferentially therearound. The first set screw is engaged with the notch.

The connector assembly of the hydraulic hose includes a crimp fitting secured to an end of the hydraulic hose, and a hose swivel extending around a crimp fitting and affixed around the fluid conduit connector of the hot stab. The hose swivel has a thread formed on an exterior surface thereof. The sleeve is threadedly engaged with the thread on the hose swivel. The fluid conduit connector has an angled portion at an end thereof. The crimp fitting has a complementary angled portion in surface-to-surface contact with the angled portion of the fluid conduit connector. The hose swivel urges the crimp fitting toward the angled portion of the fluid conduit connector. The second set screw of the sleeve is in compressive contact with the crimp fitting of the hydraulic hose. The sleeve has a slot formed in a wall thereof. The slot is suitable for receiving a spanner wrench therein. Similarly, the jam nut has a slot formed at an end thereof. The slot of the jam nut is also suitable for receiving a spanner wrench therein.

DETAILED DESCRIPTION OF THE INVENTION

Figure 1:
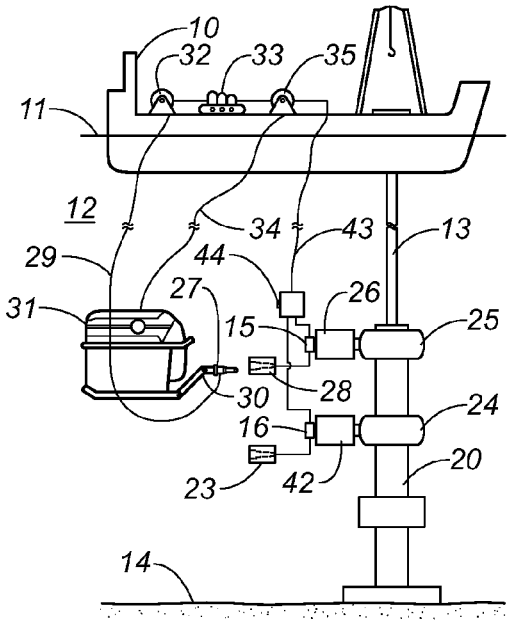
FIG. 1 Prior Art
FIG. 1 is a diagrammatic illustration of the prior art system that employs an ROV and manipulates a hot stab with a hydraulic hose connected thereto.
Figure 2:
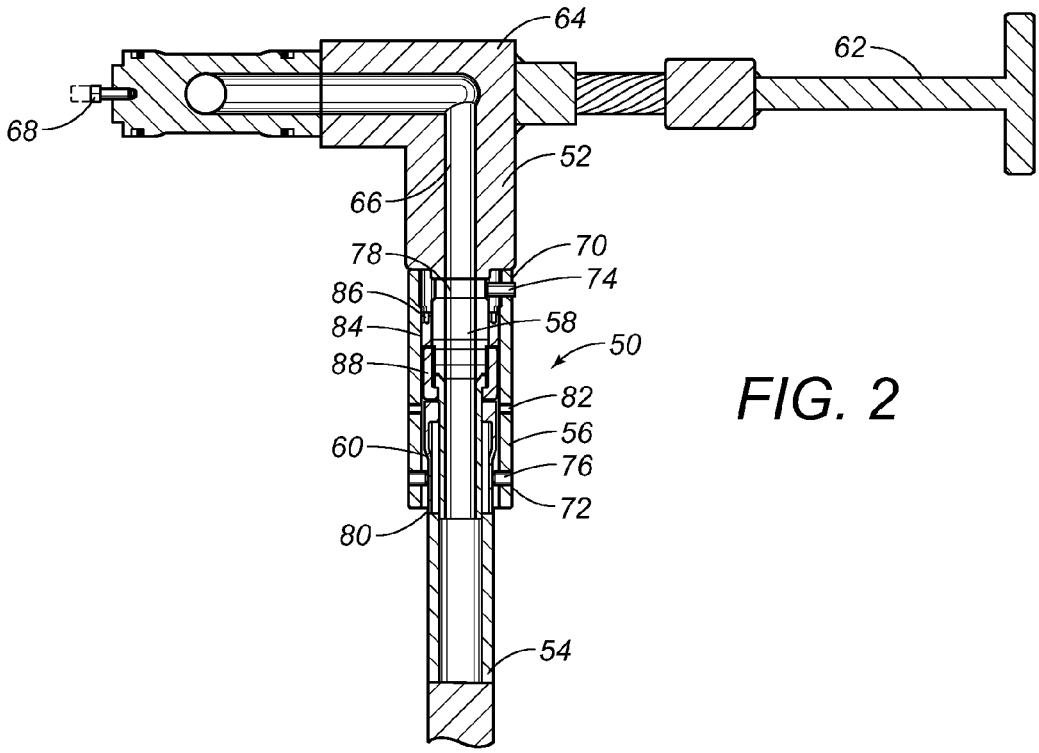
FIG. 2 is a cross-sectional view showing the leak prevention assembly as applied to the junction between the connector assembly of the hydraulic hose and the fluid conduit connector of the hot stab.

Referring to FIG. 2, there is shown the leak prevention apparatus 50 as applied to a hot stab 52 and to a hydraulic hose 54. The apparatus 50 includes a sleeve 56 that extends over the fluid conduit connector 58 of the hot stab 52 and over the connector assembly 60 of the hydraulic hose 54. In particular, the sleeve 56 is configured so as to extend over and surround the fluid conduit connector 58 and the connector assembly 60. As a result, during the manipulation of the hot stab 52, forces associated with the connection between the fluid conduit connector 58 and the connector assembly 60 are effectively transferred to the sleeve 56. This will serve to avoid leaks.

In FIG. 2, it can be seen that an ROV manipulator arm 62 extends outwardly on one side of the body 64 of the hot stab 52. A fluid delivery channel 66 extends through the interior of the body 64 so as to communicate with the outlet 68 at the end of the hot stab 52 opposite the ROV manipulator arm 62. It is intended that the outlet 62 be inserted into a suitable receptacle on the subsea well apparatus.

The hydraulic hose 54 can be in the nature of any type of conduit that serves to deliver hydraulic fluid to the fluid channel 66 of the hot stab 52. The hydraulic hose 54 can have a diameter ranging from ¼" to 2". The walls of the hose 54 are generally formed of a metal material so as to withstand the forces that are imparted to the hydraulic hose. The carcass of the hose 54 is often formed of a stainless steel material so as to effectively prevent the hose from collapsing under the forces applied thereto.

The sleeve 56 is a tubular member that has a hole 70 formed adjacent one end thereof and another hole 72 formed at an opposite end thereof. Corresponding holes can also be formed, if desired, on the opposite sides of the sleeve 56. The hole 70 serves to receive a set screw 74. Similarly, the hole 72 serves to receive set screw 76 therein. The set screw 74 is tightened so as to exert a compressive force onto the notch 78 formed circumferentially around the fluid conduit connector 58 of the body 64 of the hot stab 52. As such, the set screw 74 serves to fixedly maintain the sleeve 56 in a desired position. Similarly, the set screw 76 can be tightened so as to impart a strong compressive force onto the crimp fitting 78 of the connector assembly 60 of the hydraulic hose 54. In this manner, the sleeve 56 will be in a fixed position and generally surround the connection between the connector assembly 60 of the hydraulic hose 54 and the fluid conduit connector 58 of the hot stab 52. A slot 82 is formed into the wall of the sleeve 56. Slot 82 is suitable for receiving a spanner wrench therein. As such, the sleeve 56 can be suitably rotated so as to carry out the connection of the present invention.

A jam nut 84 extends over the fluid conduit connector 58 of the hot stab 52. As will be described hereinafter, the jam nut 84 has a threaded exterior surface that engages a threaded interior of the sleeve 56. The jam nut 84 also has a slot 86 formed at an end thereof. Slot 86 is suitable for receiving a spanner wrench therein. The thread associated with the jam nut 84 is a left hand thread.

The connector assembly 60 of the hydraulic hose 54 also includes a hose swivel 88. Hose swivel 88 has a abutment surface which serves to draw the angled surface at the end of the connector assembly 60 into a surface-to-surface contact with the angled surface at the end of the fluid conduit connector 58 of the hot stab 52. This 37° angle is conventionally used for joining the surfaces together. The hose swivel 88, as will be described hereinafter, also has a threaded exterior surface which serves to engage a threaded interior wall of the sleeve 56. As such, a rotation of the sleeve 56 (caused by the insertion of a spanner wrench into the slots 82) will draw the hose swivel 88 upwardly so as to urge the angled surfaces into proper surface-to-surface contact. Eventually, the hose swivel 88 will come into contact with an end of the jam nut 84 so as to properly fix the position of the hose swivel 88. As such, a fluid-tight surface-to-surface relationship is established between the ends of the connector assembly 60 and the fluid conduit connector 58. In this configuration, any moments or torsions that are being handled will transfer the load away from this seal surface and to the sleeve. The set screws 74 and 76 serve to transfer the load to the sleeve. The present invention provides a secure metal-to-metal seal. The bend load is transferred from the hose to the hot stab. Also, the sleeve 56 serves to keep the hose from rotating. The jam nut 84 serves to prevent the hose swivel 88 from vibrating loose. As such, leaks that can commonly occur with the prior art connection assembly are prevented by the present arrangement.

Figure 3:
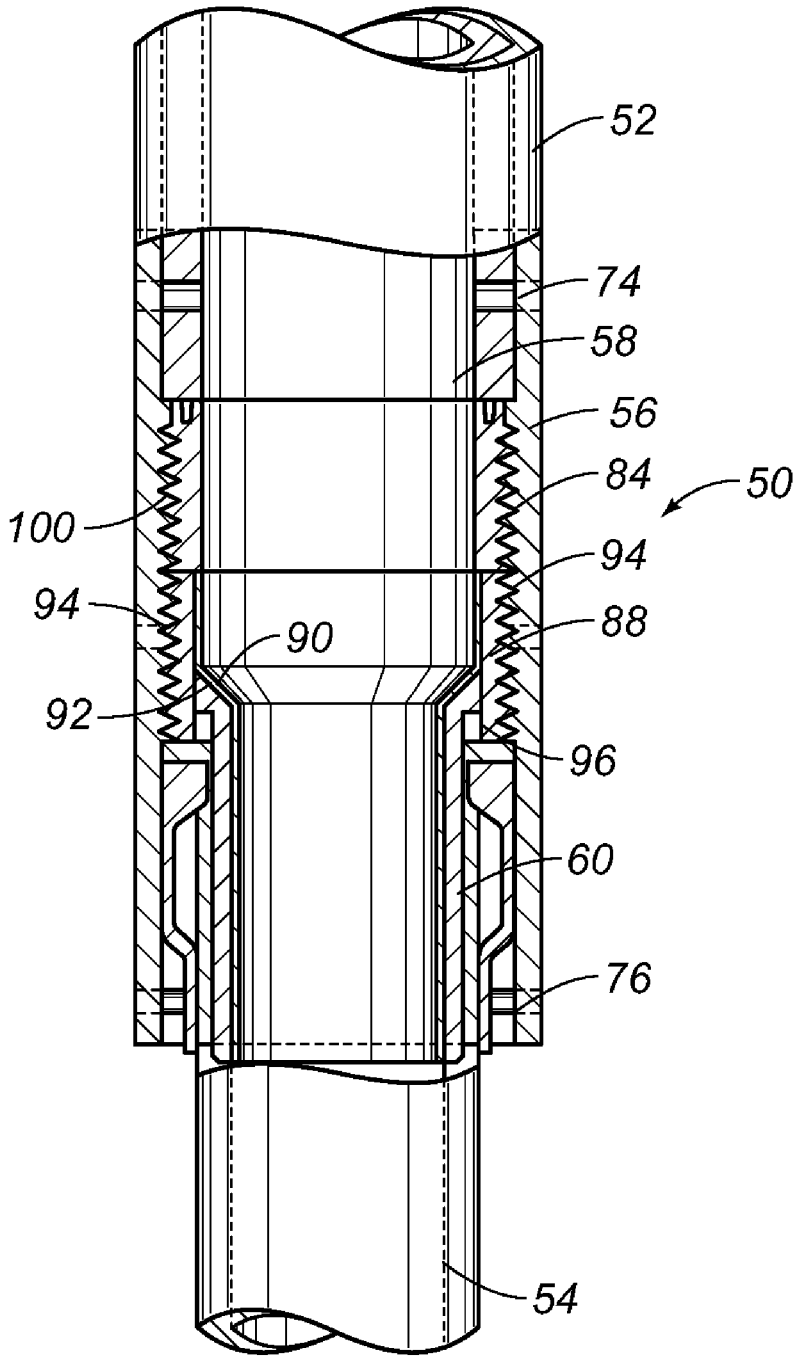
FIG. 3 is a close-up cross-sectional view showing the relationship between the various components of the leak prevention apparatus of the present invention.

FIG. 3 shows a detailed view of the connector apparatus 50 of the present invention. As can be seen, the fluid conduit connector 58 of the hot stab 52 has an angled surface 90 at an end thereof. Similarly, the crimp fitting 60 has an angled surface 92 in surface-to-surface contact with the angled surface 90 of the fluid conduit connector 58. The hose swivel 88 is illustrated as having an external thread 92. The external thread 92 engages the internal thread 94 formed on the interior of the sleeve 52. The hose swivel 88 has a shoulder 96 extending therearound. The shoulder 96 serves to abut a shoulder associated with the angled surface 92 of crimp fitting 60. As such, as the hose swivel 88 is moved by threaded engagement with the sleeve 52, the shoulder 96 will urge the angled surface 92 upwardly so as to engage angled surface 90 in a strong metal-to-metal seal.

The jam nut 84 is also illustrated as having an external thread 100 that is engaged with the internal thread associated with the sleeve 52. The jam nut 84 serves to prevent the hose swivel 88 from breaking loose. The sleeve 52 is strongly fixed into position by causing the set screw 74 to be in strong compressive contact with the outer wall of the fluid conduit connector 84. Similarly, set screw 76 is tightened so as to strongly engage the crimp fitting.

The foregoing disclosure and description of the invention is illustrative and explanatory thereof. Various changes in the details of the illustrated construction can be made within the scope of the present claims without departing from the spirit of the invention. The present invention should only be limited by the following claims and their legal equivalents.

I claim:

1. An apparatus comprising:

a hot stab having a fluid conduit connector thereon, said fluid conduit connector having a tubular portion;

a hydraulic hose having a connector assembly at an end thereof, said connector assembly comprising:

a crimp fitting affixed over and circumferentially around an end of said hydraulic hose; and a hose swivel extending around said crimp fitting and extending around an end of said tubular portion of said fluid conduit connector of said hot stab, said hose swivel having a thread formed on an exterior surface thereof;

a jam nut connected over said tubular portion of said fluid conduit connector in spaced relation to said end thereof, said jam nut having a threaded exterior surface;

a sleeve affixed to said hot stab and to said hydraulic hose so as to extend over said fluid conduit connector and said connector assembly, said sleeve being threadedly engaged with said thread of said hose swivel and with said threaded exterior surface of said jam nut, said sleeve having a length extending entirely over and beyond said hose swivel and said jam nut.

2. The apparatus of claim 1, said sleeve having a first hole formed through a wall thereof adjacent one end and a second hole formed through said wall thereof adjacent an opposite end, the apparatus further comprising:

a first set screw affixed in said first hole and in compressive contact with a surface of said fluid conduit connector; and a second set screw affixed in said second hole and in compressive contact with a surface of said connector assembly of said hydraulic hose.

3. The apparatus of claim 2, said tubular portion of said fluid conduit connector having a notch formed circumferentially therearound, said first set screw engaged with said notch.

4. The apparatus of claim 1, said fluid conduit connector having an angled portion at an end thereof, said crimp fitting having a complementary angled portion in surface-to-surface contact with said angled portion of said fluid conduit connector, said hose swivel urging said crimp fitting toward said angled portion of said fluid conduit connector.

5. The apparatus of claim 2, said connector assembly of said hydraulic hose having said crimp fitting secured to an end of said hydraulic hose, said second set screw being in compressive contact with said crimp fitting of said hydraulic hose.

6. The apparatus of claim 1, said threaded exterior surface of said jam nut being a left handed thread.

7. The apparatus of claim 1, said sleeve having a slot formed in a wall thereof, said slot being suitable for receiving a spanner wrench therein.

8. The apparatus of claim 1, said jam nut having a slot formed at an end thereof, said slot suitable for receiving a spanner wrench therein.

9. A connector assembly for joining a hydraulic hose to a fluid conduit connector of a hot stab, the hydraulic hose having a crimp fitting affixed over and around an end thereof, the connector assembly comprising:

a sleeve having one end suitable for receiving an end of the hydraulic hose and an opposite end suitable for affixing to a fluid conduit connector of the hot stab, said sleeve having a first hole formed through a wall thereof adjacent said one end and a second hole formed through said wall thereof adjacent said opposite end;

a first set screw affixed in said first hole and suitable for compressive contact with a surface of the fluid conduit connector;

a second set screw affixed in said second hole and suitable for compressive contact with a surface of the hydraulic hose;

a jam nut threadedly affixed in said sleeve in a location spaced from and between said first and second set screws, said jam nut suitable for positioning over the fluid conduit connector of the hot stab; and a hose swivel suitable for fitting around the crimp fitting, said hose swivel being affixed within said sleeve in a position spaced from and between said first and second set screws, said hose swivel having a thread formed on an exterior surface thereof, said sleeve being threadedly engaged with said thread on said hose swivel.

10. The connector assembly of claim 9, said jam nut having a threaded exterior surface, said sleeve being threadedly connected to said threaded exterior surface of said jam nut.

11. The connector assembly of claim 9, the fluid conduit connector having an angled portion at an end thereof, the crimp fitting having a complementary angled portion, said hose swivel having a surface contacting said crimp fitting so as to urge the complementary angled portion into contact with the angled portion as said sleeve is rotated.

12. The connector assembly of claim 9, said sleeve having a slot formed in a wall thereof, said slot being suitable for receiving a spanner wrench therein.

* * * * *